US010502526B2

(12) United States Patent
Norris et al.

(10) Patent No.: US 10,502,526 B2
(45) Date of Patent: Dec. 10, 2019

(54) SYSTEMS AND METHODS FOR GENERATING TARGETING BEAMS

(71) Applicant: Wrap Technologies, Inc., Las Vegas, NV (US)

(72) Inventors: Elwood Norris, Poway, CA (US); John Bailey, Poway, CA (US)

(73) Assignee: Wrap Technologies, Inc., Las Vegas, NV (US)

( * ) Notice: Subject to any disclaimer, the term of this patent is extended or adjusted under 35 U.S.C. 154(b) by 0 days.

(21) Appl. No.: 16/161,773

(22) Filed: Oct. 16, 2018

(65) Prior Publication Data

US 2019/0113308 A1 Apr. 18, 2019

Related U.S. Application Data

(60) Provisional application No. 62/573,932, filed on Oct. 18, 2017.

(51) Int. Cl.

| | |
|---|---|
| ***F41G 1/35*** | (2006.01) |
| ***F41G 1/46*** | (2006.01) |
| ***F42B 12/56*** | (2006.01) |
| ***F41H 13/00*** | (2006.01) |

(52) U.S. Cl.

CPC ..... *F41G 1/46* (2013.01); *F41G 1/35* (2013.01); *F41H 13/0006* (2013.01); *F42B 12/56* (2013.01)

(58) Field of Classification Search

CPC ..... F41G 1/35; F41G 11/002; F41G 11/001; F41G 11/00; F41G 3/145

See application file for complete search history.

(56) References Cited

U.S. PATENT DOCUMENTS

| | | | |
|---|---|---|---|
| 1,217,415 | A | 2/1917 | Colomyjczuk |
| 1,229,421 | A | 6/1917 | Downs |
| 1,276,689 | A | 8/1918 | Poudrier |
| 1,304,857 | A | 5/1919 | Davis |
| 1,343,747 | A | 6/1920 | Radakovich |
| 1,488,182 | A | 3/1924 | Whelton |
| 1,536,164 | A | 5/1925 | Tainton |
| 2,354,451 | A | 7/1944 | Forbes |
| 2,372,383 | A | 3/1945 | Lee |
| 2,373,363 | A | 4/1945 | Wellcome |
| 2,373,364 | A | 4/1945 | Wellcome |
| 2,455,784 | A | 12/1948 | Lapsensohn |
| 2,611,340 | A | 9/1952 | Manning |
| 2,668,499 | A | 2/1954 | Mourlaque |

(Continued)

OTHER PUBLICATIONS

PCT Application No. PCT/US18/56068 Filing Date Oct. 16, 2018 Troy Chambers International Search Report dated Jan. 15, 2019; 11 Pages.

*Primary Examiner* — J. Woodrow Eldred

(74) *Attorney, Agent, or Firm* — Thorpe North & Western, LLP

(57) ABSTRACT

A system for generating a targeting beam includes a frame carrying at least one moveable arm, at least a portion of the moveable arm being moveable relative to the frame. A light source is carried by the frame, the light source being operable to generate a light beam. A motor is carried by the frame, the motor being operable to create oscillatory motion of the moveable arm to cause the light beam generated by the light source to oscillate through a range of motion to create a targeting beam.

5 Claims, 7 Drawing Sheets

(56) References Cited

U.S. PATENT DOCUMENTS 2,797,924 A 7/1957 Stewart
3,085,510 A 4/1963 Campbell
3,340,642 A 9/1967 Vasiljevic
3,484,665 A 12/1969 Mountjoy et al.
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,561,263 A 10/1996 Baillod
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,412,975 B2 8/2008 Dillon, Jr.
7,444,939 B2 11/2008 McNulty et al.
7,444,940 B2 11/2008 Kapeles et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin et al.
7,950,329 B1 5/2011 Nemtyshkin et al.
7,984,676 B1 7/2011 Gavin et al.
8,015,905 B2 9/2011 Park
8,024,889 B2 9/2011 Bunker
8,082,199 B2 12/2011 Kwok
8,141,493 B1 3/2012 Kuchman
8,186,276 B1 5/2012 Olden et al.
8,231,474 B2 7/2012 Stethem
8,261,666 B2 9/2012 Garg
8,281,776 B2 10/2012 Körver et al.
8,339,763 B2 12/2012 McNulty, Jr.
8,441,771 B2 5/2013 Hinz et al.
8,601,928 B2 12/2013 Martinez et al.
8,671,841 B2 3/2014 Raquin et al.
8,677,675 B2 3/2014 Koch
8,695,578 B2 4/2014 Olden et al.
8,857,305 B1 10/2014 Tseng
8,896,982 B2 11/2014 Beechey et al.
8,899,139 B2 12/2014 Brill et al.
9,025,304 B2 5/2015 Brundula et al.
9,157,694 B1 10/2015 Tseng
9,220,246 B1 12/2015 Roman
9,255,765 B2 2/2016 Nelson
9,303,942 B2 4/2016 Sievers
9,335,119 B2 * 5/2016 Werner ..... F41G 1/35
9,414,578 B2 8/2016 Thornbrough
9,638,498 B2 5/2017 Chang
10,107,599 B2 10/2018 Norris et al.
2002/0134365 A1 9/2002 Gray
2002/0170418 A1 11/2002 McNulty, Jr. et al.
2003/0165041 A1 9/2003 Stethem
2003/0165042 A1 9/2003 Stethem
2004/0245338 A1 * 12/2004 Poloniewicz ..... G06K 7/10653 235/454
2005/0166441 A1 8/2005 Mattox
2006/0112574 A1 6/2006 Hodge et al.
2007/0019358 A1 1/2007 Kroll
2007/0101893 A1 5/2007 Shalev et al.
2007/0264079 A1 11/2007 Martinez et al.
2009/0084284 A1 4/2009 Martinez et al.
2010/0126483 A1 5/2010 Makowski
2010/0315756 A1 12/2010 Gavin
2011/0005373 A1 1/2011 Martinez et al.
2011/0271825 A1 11/2011 Howland
2012/0019975 A1 1/2012 Hanchett et al.
2012/0210904 A1 8/2012 Merems
2014/0331984 A1 11/2014 Brahler, II et al.
2014/0334058 A1 11/2014 Galvan et al.
2015/0075073 A1 3/2015 Sylvester
2015/0168107 A1 6/2015 Tseng
2015/0241180 A1 8/2015 Pruett
2015/0276351 A1 10/2015 Teetzel et al.
2015/0316345 A1 11/2015 Brahler, II et al.
2016/0010949 A1 1/2016 Teetzel et al.
2016/0161225 A1 6/2016 Searle et al.
2016/0238350 A1 8/2016 Tseng
2017/0160060 A1 6/2017 Purvis
2017/0241751 A1 8/2017 Nerheim
2017/0276461 A1 9/2017 Norris et al.
2018/0003462 A1 * 1/2018 Chavez ..... F41G 1/345
2018/0292172 A1 * 10/2018 Ehrlich ..... F41G 1/36

* cited by examiner

SYSTEMS AND METHODS FOR GENERATING TARGETING BEAMS

PRIORITY CLAIM AND RELATED CASES

Priority is claimed of and to U.S. Provisional Patent Application Ser. No. 62/573,932, filed Oct. 18, 2017, which is hereby incorporated herein by reference in its entirety. This application is related to U.S. patent application Ser. No. 15/467,958, filed Mar. 23, 2017, which is hereby incorporated herein by reference in its entirety.

BACKGROUND OF THE INVENTION

Field of the Invention

The present invention relates generally to optical sight systems for aligning or aiming weapons, measuring and surveying devices, and the like.

Related Art

Optical laser sights are often used with weapons to aid a user in properly aiming the weapon. A laser sight is a small, usually visible-light laser placed on a handgun or a rifle and aligned to emit a beam parallel to the barrel. Since a laser beam has low divergence, the laser light appears as a small spot even at long distances; the user places the spot on the desired target and the barrel of the gun is aligned at the location at which the laser sight is directed.

While such laser sights have proved popular to some degree, there remain applications where targeting a specific point is impractical or undesirable for a number of reasons. To this end, laser-dispersing lenses have been used to spread the light beam produced by the laser into a "crosshair" pattern instead of a single point. While these devices succeed in "spreading" the laser beam into a two-dimensional pattern, the laser light that forms the resultant crosshair continues to spread as it exits the dispersing lens. This creates a pattern of varying size and intensity, depending on the distance of the targeted surface from the laser sight. Some dispersing lenses disperse the beam to such a degree that the resultant crosshair fades significantly upon reaching a targeted surface, rendering them less effective.

SUMMARY OF THE INVENTION

In accordance with one aspect of the invention, a system for generating a targeting beam is provided, including a frame carrying at least one moveable arm. At least a portion of the moveable arm is moveable relative to the frame. A light source can be carried by the frame, the light source being operable to generate a light beam. A motor can be carried by the frame, the motor operable to create oscillatory motion of the moveable arm to cause the light beam generated by the light source to oscillate through a range of motion to create a targeting beam.

In accordance with another aspect of the invention, a system is provided for generating a targeting beam. The system can include a launcher and a frame coupled to or formed as a portion of the launcher. The frame can carry at least one moveable arm with at least a portion of the moveable arm being moveable relative to the frame. A light source can be carried by the moveable arm, the light source being operable to generate a light beam. A motor can be carried by the moveable arm, the motor can be operable to create oscillatory motion of the moveable arm to cause the light beam generated by the light source to oscillate through a range of motion to create a targeting beam. A shock isolation material can be coupled to the launcher. The frame can be coupled to the shock isolation material such that the shock isolation material shields the frame from vibration caused by activation of the launcher.

In accordance with another aspect of the invention, a system is provided for generating a targeting beam, including a launcher and a frame coupled to or formed as a portion of the launcher. The frame can carry at least one moveable arm, at least a portion of the moveable arm being moveable relative to the frame. A light source can be carried by the moveable arm, the light source being operable to generate a light beam. A motor can be carried by the moveable arm. The motor can be operable to create oscillatory motion of the moveable arm to cause the light beam generated by the light source to oscillate through a range of motion to create a targeting beam. A switching assembly can be operable to energize the light source and/or the motor, the switching assembly including a magnetic material, the magnetic material being moveable relative to the frame.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1A:
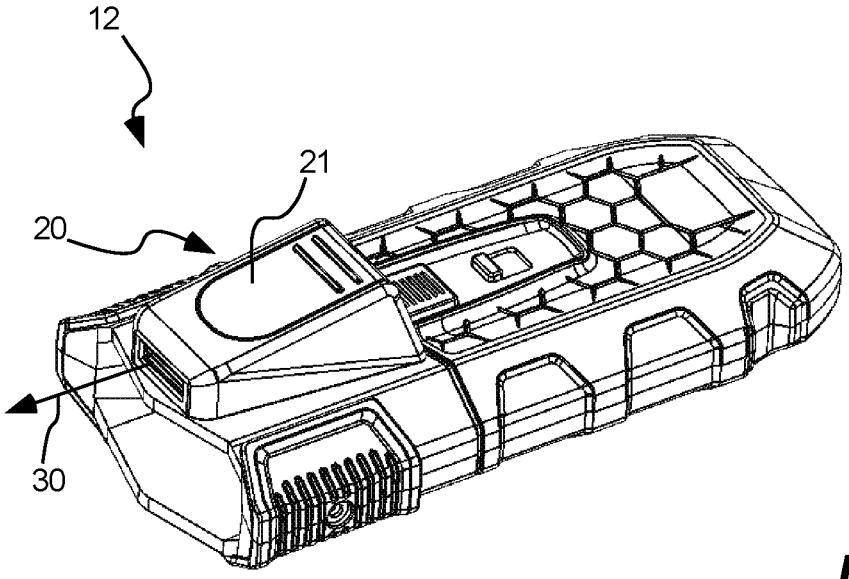
FIG. 1A is a perspective view of a launching device or launcher having a targeting beam generator attached thereto in accordance with the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a motor" can include one or more of such motors, if the context dictates. Reference to a motor can also include other mechanical or electrical motion inducing devices to create movement.

As used herein, the term "launcher" refers to any of a variety of devices capable of launching, propelling or otherwise discharging a projectile. Suitable examples of launchers are discussed in related U.S. patent application Ser. No. 15/467,958, filed Mar. 23, 2017, which is hereby incorporated herein by reference in its entirety. Other suitable launchers include, without limitation, known firearms, EMD (electro-muscular discharge) weapons, non-lethal weapons of various types, and the like.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to systems for providing optical sighting aids for weapons, measuring instruments, surveying equipment and the like. The technology provides a manner by which light beams can be better utilized to provide a targeting beam or horizontal line upon a desired surface, rather than a small point of light. While the present technology can be used in a variety of applications, it is well suited for use with relatively short-range weapons or launchers that may be aimed at irregular or moving surfaces.

Figure 1B:
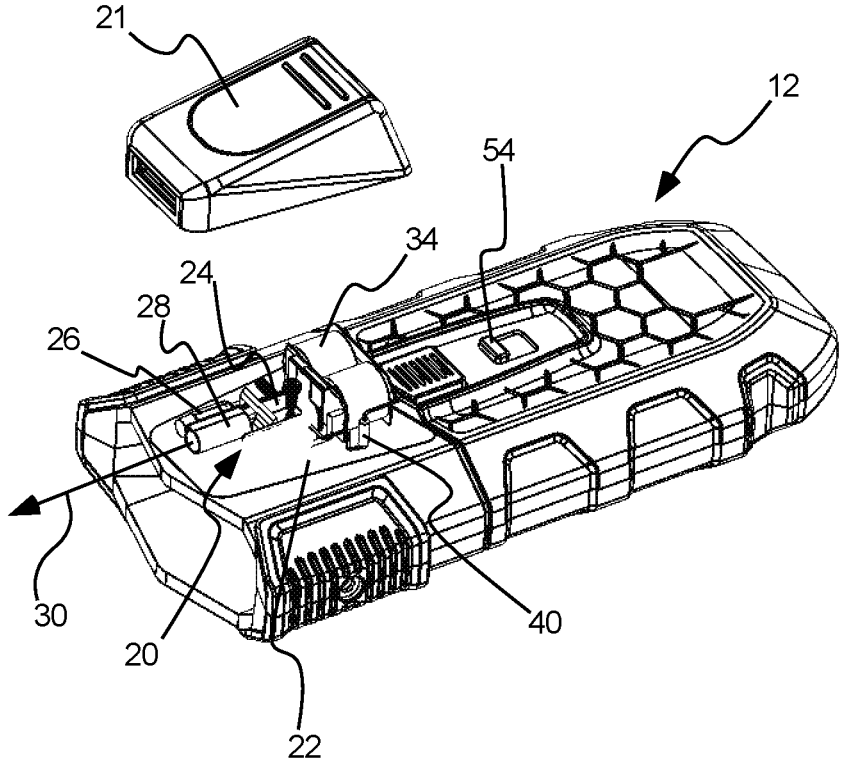
FIG. 1B is a perspective view of the launcher of FIG. 1, shown with a targeting beam generator housing removed therefrom.

One such exemplary device is shown at 12 in FIGS. 1A and 1B. This launcher 12 (absent the casing 21) is disclosed in detail in U.S. patent application Ser. No. 15/467,958, filed Mar. 23, 2017, which is hereby incorporated herein by reference in its entirety. The launcher 12 carries a pair of pellets coupled to one another by a tether (neither shown nor discussed in detail herein). The pellets are launched with great force from the launcher 12 toward a subject, which causes the pellets to separate and pull the tether into a taught configuration until contacting the subject. After contact, the tether wraps about the subject, thereby immobilizing the subject. The power source used to launch the tether and pellets from the launcher can vary, but oftentimes involves the sudden release of a wave of pressurized gas.

Figure 2:
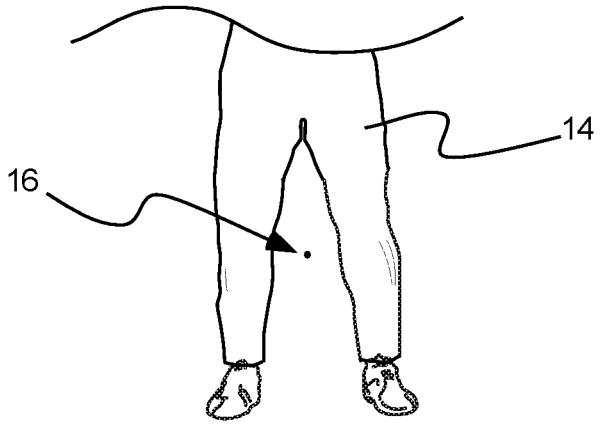
FIG. 2 PRIOR ART
FIG. 2 is a front view of a portion of a subject being targeted by a Prior Art targeting system.
Figure 3:
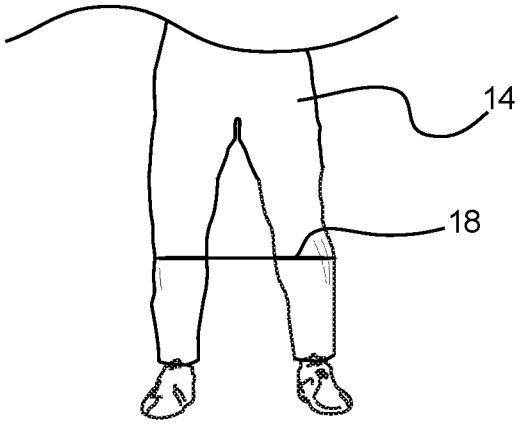
FIG. 3 is a front view of the subject of FIG. 2 being targeted with a targeting beam generated in accordance with the present technology.

An exemplary subject 14 toward which the launcher 12 may be aimed is shown in FIGS. 2 and 3. As this type of device is often directed toward a user's legs, conventional aiming systems have proven to be less than desirable. As shown for example in FIG. 2, if it is desired to provide an aiming guide to the launcher, for example a conventional "laser sight," it is often difficult for a user to properly target a user with such a laser. The laser output, shown for example at 16, is very small compared to the user, and is often not easy to discern even at the typically short ranges that such a device is used. To exacerbate this problem, the subject 14 is generally moving when the launcher 12 is deployed: as such, the small point of light often resolves behind the subject as it passes through the subject's legs. Also, it is often desired to sight the launcher to a vertical center of the subject—if the launcher is directed toward the subject's legs, the legs may be splayed relative to one another, in which case the conventional laser would resolve on a surface behind the subject, rendering it ineffective.

The present technology provides a manner by which a target beam is generated, a beam that is generally wider and more easily visualized than a typical point laser sight generating a dot. This beam is much more effective when used with devices such as the launcher 12 shown. FIG. 3 illustrates this target beam 18 directed toward user 14. Note that the beam can be much more accurately positioned on the user's legs than conventional point aiming systems. Despite the areas where the beam is not as easily visible (e.g., the stretch between the user's legs) the beam can still be easily seen and positioned on the legs of the subject. Even in the event the subject's legs are moving, the beam remains visible by the human eye. The beam can also be much more easily centered relative to the subject's vertical centerline, as an end of the targeting beam can be positioned on each of the subject's legs.

In addition, the beam can be aligned with a desired horizontal orientation of the launcher with which it is associated. The beam can then impart information to the user as to the orientation of the launcher, and the user can adjust the position of the launcher accordingly to ensure the launcher is properly oriented (both position-wise and orientation-wise). For example, the beam generating system can be aligned with the launcher such that when the launcher is properly oriented for use, the beam is true to horizontal. Thus, a user can determine proper orientation of the launcher by visualizing only the generated beam. This cannot be accomplished with conventional, point lasers.

As will be appreciated from FIGS. 1A and 1B, the present technology can generate this beam using components that can be incorporated into a very small package size, adding very little to the overall size of such devices. The beam generating system 20 can be attached as shown atop (or beneath) such devices or incorporated into the device. As the system uses very little power, it can be powered with a power source (not shown) already provided with the launcher 12, or a very low-cost and lightweight lithium battery power source (shown by example at 34 in FIGS. 1B and 9) can easily be incorporated into the present system 20 or the launcher 12. Batteries as small as "1/2 AA" lithium batteries can provide sufficient output for the device. In some embodiments, the system can be powered by two "1/3 N" batteries, run in parallel. These can provide 45-50 minutes of continuous operation. As the device is rarely used continuously, this power supply can provide ample power for many weeks of service.

In one embodiment, activation of the system 20 can be associated with a function of the launcher 12. For example, in many cases the launcher will have a "safety" setting in which the launcher will not fire. When the launcher is switched into a non-safe condition (e.g., a ready-to-fire condition), the beam generating system 20 can be automatically activated. In this manner, an operator need not independently power up the beam generating system 20 prior to using the launcher. This function is discussed in more detail below in connection with external switch 54.

One exemplary system 20 for generating a targeting beam is shown in more detail in FIGS. 4A through 4D. The system can include a frame, a base of which is shown generically at 22. The frame can include at least one moveable arm 24 that is generally mounted to the base. In the example shown, the moveable arm is fixed relative to the base via clamping or mounting braces 26. A light source 28 can be coupled to the moveable arm. The light source can be any of a variety of types of light sources, but in one example is a commercially available green laser. The light source can be operable to generate a laser light beam, shown representatively at reference 30.

Figure 4A:
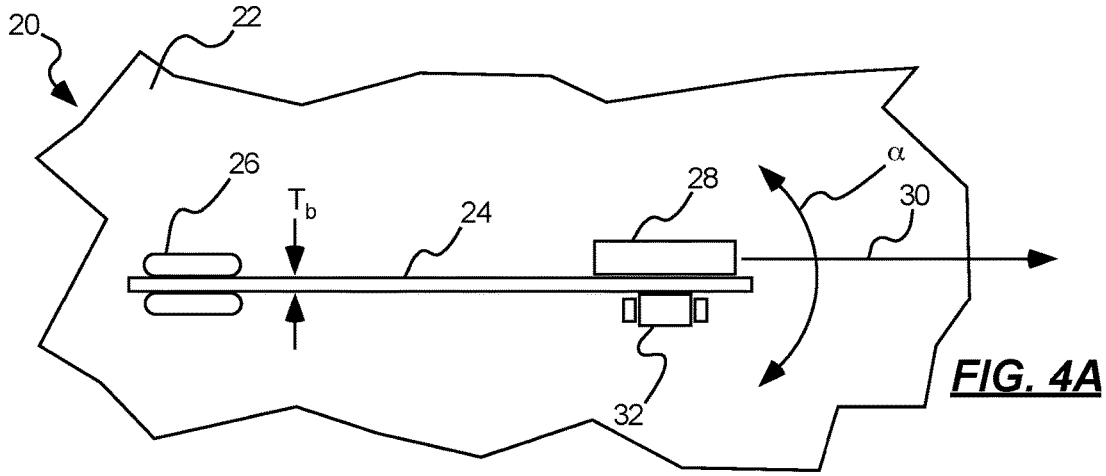
FIG. 4A is a top, schematic view of an exemplary beam generating system in accordance with an embodiment of the invention.
Figure 4B:
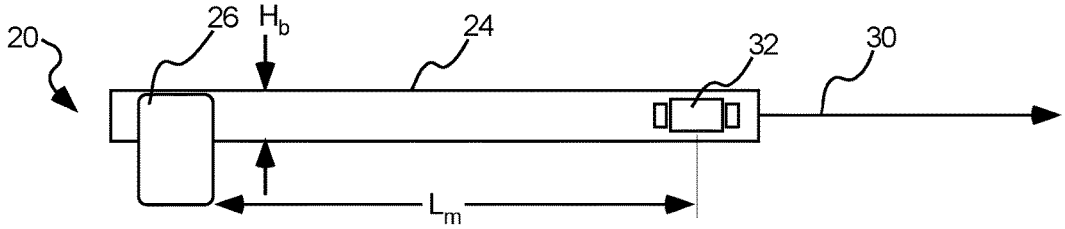
FIG. 4B is a side, schematic view of the system of FIG. 4A.
Figure 4C:
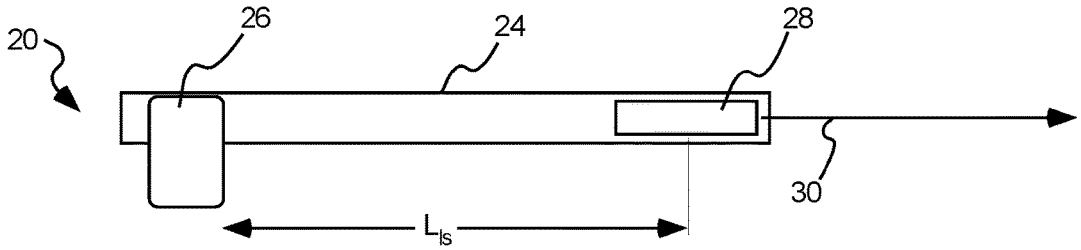
FIG. 4C is a schematic, opposing side view of the system of FIG. 4A.
Figure 4D:
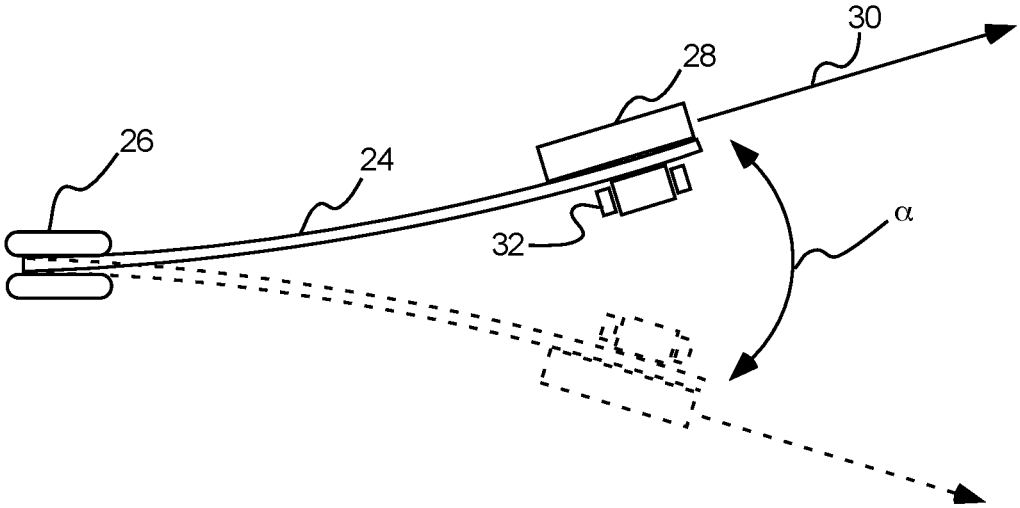
FIG. 4D is a schematic, top view of the system of FIG. 4A, with the moveable arm shown in two representative positions as it moves through an arc.

A motor 32 can be operable to create oscillatory motion of the moveable arm. In the example shown in the figures, this oscillatory motion takes the form of a beam that includes one end free to move, but fixed relative to the frame in another location along the beam. This oscillating motion causes the light beam generated by the light source 28 to oscillate through a predetermined range of motion. The beam pattern 18 shown in FIG. 3 is one example of the pattern created by the light beam. FIG. 4D illustrates two exemplary positions of the moveable arm as it oscillates through arc "$\alpha$."

While the motor 32 can take a variety of forms, in one embodiment it comprises a micro motor. The motor can be or can include a vibration motor. Vibration motors are known drivers that often are of two basic types: eccentric rotating mass vibration (ERM) motors and linear resonant actuator (LRA) motors. ERM motors use a small unbalanced mass on a DC motor shaft that, upon rotation, creates a force imbalance that translates to a vibratory motion. LRA motors contain a small internal mass attached to a spring, which creates an unbalanced force when driven. In the examples shown, an ERM motor is used that is coupled to a beam (movement arm 24). As the motor rotates, it causes the free end of the beam to oscillate or vibrate in a predetermined pattern.

In addition to utilizing motors that create movement of the arm 24 by way of vibrational forces, other motors can be utilized so long as oscillatory motion of the arm is generated. Examples of such motors include, without limitation, piezoelectric rotational motors, mechanical "wind up" spring assemblies, and the like.

The light beam generated by the present technology is the result of the light source 28 oscillating very quickly through a predetermined range of motion. For example, as shown in FIG. 4A, the various components of the system can be tuned to create a known arc "$\alpha$" through which the light source continually oscillates. As the light beam is directed to a surface, the light pattern that resolves on the surface appears to the human eye to be a solid targeting beam or continuous line of light (e.g., that pattern shown at 18 in FIG. 3). FIG. 4D illustrates an exemplary range of motion of the moveable arm 24.

The beam that the human eye and brain processes appears to be a solid beam but in fact is a single dot oscillating backward and forward in a longitudinal direction. Unlike a traditional optic lens that disburses the total light energy of a laser dot to a beam or crosshair pattern, the perceived beam in the subject invention is perceived to be the same intensity as the source dot. As an illustration a 1 milliwatt ("mw") laser source will be perceived as a 1 mw beam or line of light all along the targeting beam width, whereas a lens would result in diminished intensity spreading the 1 mw laser source dot. Since lasers are often regulated to limit their intensity, the subject invention enhances the effectiveness of a targeting beam equivalent to the intensity of the laser dot energy source.

The rate at which the beam 24 moves through arc "$\alpha$" can be controlled through a number of variables. The motor 32 can be chosen to produce a desired amplitude (displacement) and frequency of vibration, which correlates to a desired response of the beam. In addition, as shown in FIGS. 4A through 4C, a variety of physical characteristics can be varied to achieve desired outcomes. A thickness $T_b$ of the beam can be varied, as can a height $H_b$, as can a rigidity/stiffness of the beam, etc. The rigidity/stiffness of the beam can be varied by material selection, cross section/geometry of the beam (e.g., using an I-beam or the like), or purposefully adding weights, additions of dissimilar material strips, blocks or coatings, etc., to lessen or increase a flexibility of the beam.

In addition, in the examples shown, the motor 32 is mounted upon the moveable arm 24 at a distance $L_m$ (FIG. 4B), and the light source 28 is mounted upon the moveable arm at a distance $L_{ls}$ (FIG. 4C). A response of the moveable arm can be tuned by altering the position of these components relative to the clamping base 26. While the light source and motor are shown attached to the beam at generally the same length, they can be offset from one another, as shown for example in FIG. 7. Also, the specific light source and motor can be selected based on their size, weight, etc., to create a desired response.

The moveable arm can also be configured to move in orientations to create a crosshair pattern or a circle pattern or a variety of shapes in addition to a horizontal beam. Circular patterns may be beneficial for launchers that propel projectiles in a wide or spreading pattern, such as shotguns, beanbag launchers, etc. Where appropriate, multiple light sources can be provided to create a desired targeting beam configuration. Unlike the previous approaches to spreading the light from a laser beam, this configuration does not diminish the light intensity as the beam spreads out across the target, as described above.

Figure 5:
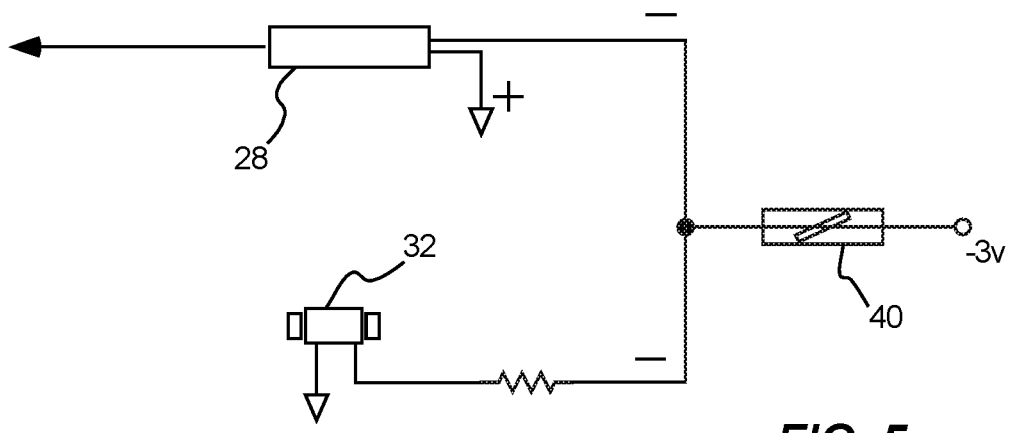
FIG. 5 is a schematic diagram of an exemplary circuit in accordance with an embodiment of the invention.
Figure 6:
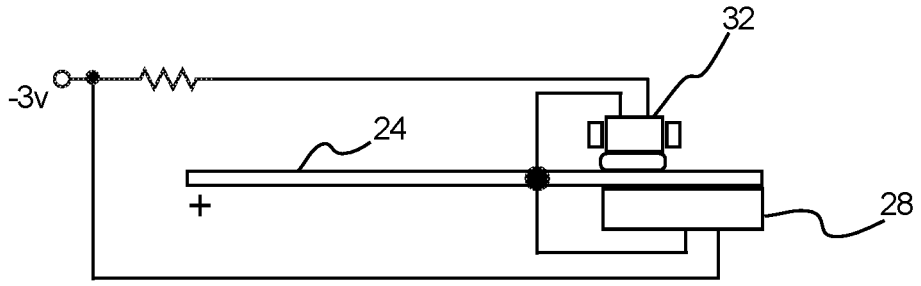
FIG. 6 is a schematic diagram of another exemplary circuit in accordance with an embodiment of the invention.

FIGS. 5 and 6 illustrate two exemplary circuits in accordance with the present invention. While in no way limiting the present technology, in the example of FIG. 5, a 3-volt power source is provided that is selectively provided to the light source 28 and motor 32 by way of switch 40. In one example, the switch comprises a small magnetic reed switch. The resistance "R" can be used to slow the motor revolution and can, for example, be 33 ohms.

In the example shown in FIG. 6, a similar circuit is provided, with moveable arm or beam 24 being formed of or including an electrically conductive material. Suitable examples of such a material include, without limitation, brass, steel, aluminum, etc. The beam can be coupled to a positive power source of 3 volts, and each of the motor 32 and the light source 28 can be both physically coupled to or carried by the beam, and can be electrically coupled to the beam. This example can be advantageous in that the components of the present technology are generally very small and relative weights of various components can significantly affect the operation of the system. By forming the moveable arm as an electrical conductor, the number of wire leads that must be coupled to various components can be significantly reduced. In other examples, the moveable arm can be formed from a polymer. Where desirable, the polymer can include electrically conductive materials applied thereto, or formed therein.

Figure 7:
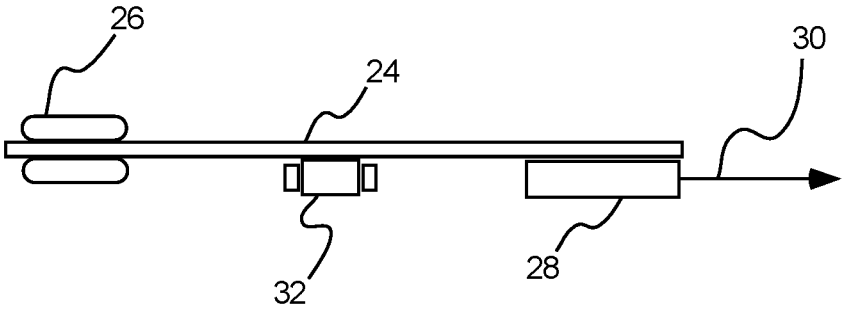
FIG. 7 is a top, schematic view of another targeting beam generating system in accordance with the technology.
Figure 8:
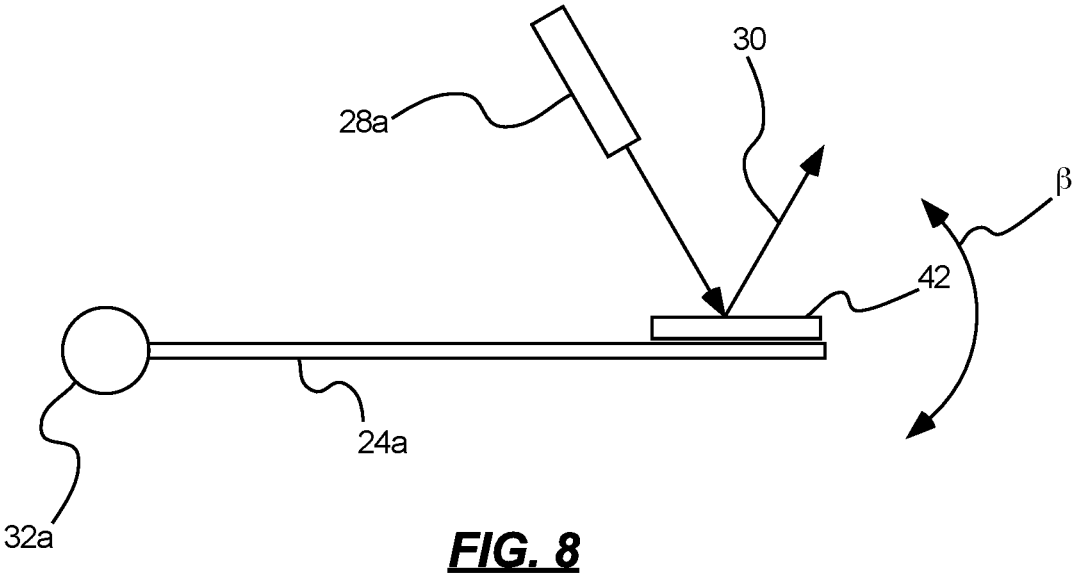
FIG. 8 is a top, schematic view of another targeting beam generating system in accordance with the present technology.

FIGS. 7 and 8 are schematic, top views of other exemplary arrangements of the components discussed above. As referenced above, the ability to vary the sizes, weights, geometries, positions, etc., of the various components can allow tailoring of the output of the light source to create any particular targeting beam desired. In the embodiment illustrated in FIG. 7, the motor 32 and light source 28 are positioned on the same side of the arm or beam 24, but spaced from one another. By varying relative positions of the motor and light source, the sizes and/or masses of the motor and light source need not be varied to achieve a particular result—in this manner, consistency in part selection can be maintained while providing adjustability to overall performance of the system.

The use of a vibratory motor to induce movement of the moveable arm provides additional advantages. For example, as the motor oscillates during normal operation, it causes the launcher 12 to also vibrate. This vibratory motion can easily be sensed by the user and thereby provides to the user tactile input as to the operational condition of the beam generating system. In other words, the user can easily determine when the beam generating system is activated for use. In those embodiments in which the beam generating system is activated by the same switch that removes the launcher from "safe" mode, the user can easily determine, from tactile feedback alone, whether the launcher is ready to fire or is still in safe mode.

FIG. 8 illustrates a further embodiment of the invention in which the light source 28*a* is maintained stationary relative to motor 32*a*. In this example, motor 32*a* is maintained stationary relative to a base of the device, as is light source 28*a*. Oscillatory rotation of motor 32*a* causes moveable arm or beam 24*a* to oscillate through arc "β" Mirror or light reflective surface 42 is carried by the moveable arm. As the moveable arm oscillates, a point at which the laser contacts the mirror changes, which in turn changes the reflected direction of the light beam, which results in the creation of a targeting beam at a location distant from the system. One advantage of this orientation is the light source may be at a different angle than the emission direction allowing a more compact component orientation to a subject device.

Regardless of the specific relationship between the light source 28, the moveable arm 24 and the motor 32, the present technology can be easily tuned to generate a number of desirable outputs. In one exemplary embodiment, however, the system runs on a power source of only about 3.6 volts DC and weighs less than about 18 grams. In one example, the motor is a 3-5 volt micromotor powered with about 1 volt. The entire system can be provided in a package size less than about 1"×1.25"×0.375". In one embodiment, the laser can be a 5 mw type and the motor can be a 1.5 v to 3.6 volt type. The resultant oscillation of the light source can be at least about 24 Hz, or greater. The light beam generated can be about 2 feet wide at a distance of about 15 feet.

Figure 10:
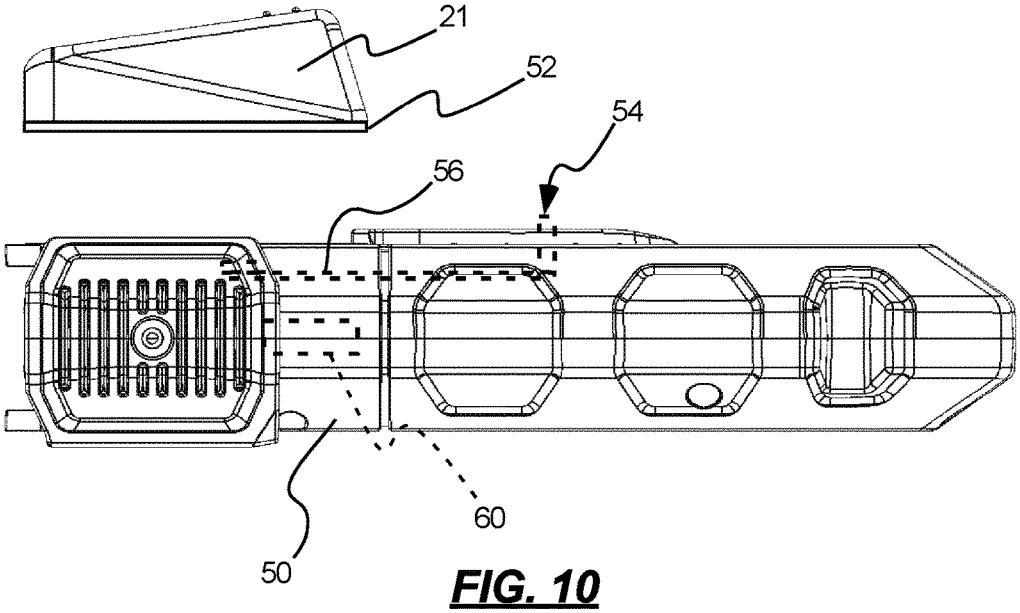
FIG. 10 is a side, partially exploded view of a launcher carrying a beam generating system in accordance with the present technology.

This small size can be packaged in a housing 21 (FIGS. 1A, 1B and 10) that can be small enough to enable attachment of the beam generating system on a launcher without negatively impacting other operable components of the launcher. FIG. 10 illustrates the housing 21 removed from a casing 50 of the launcher. In this case, the housing can be attached atop the launcher in a position that does not interfere with other operable components of the launcher, and also provides a clear path for the light beam 30. The beam generating components can also be integrated within the launcher body whereupon a separate housing may not be not required.

Also shown in FIG. 10 is a shock isolation material 52 that can be coupled beneath the housing containing the beam generating components. The shock isolation material can be beneficial in protecting the relatively delicate components of the beam generating system from sudden shocks generated by the launcher. In many cases the launcher includes a charge or power source (shown schematically at 60 in FIGS. 9 and 10) used to launch or propel a projectile from the launcher. In some cases, this power source is ballistic charge utilizing gunpowder or the like. In other cases, compressed gasses can be suddenly released to create a pressure wave to propel the projectile. In some launchers, mechanical springs can be utilized.

Whichever propellant system is utilized in the launcher 12, it very often generates a sudden and powerful shock wave. As the beam generating system can include delicate components, this shock wave can damage or imbalance the components within the housing 21, rendering them less effective for later usage. The shock isolation material 52 can insulate the beam generating components from the shock generated by the power source. The shock isolation material can take a variety of forms. In one example, the material is an adhesive tape sold under the tradename Gecko Grip. The shock isolation layer can be formed as flexible, adhesive layer having properties similar to foam. When subject to a shock or impact, the foam absorbs energy and limits transmission of vibrations through the casing 50 of the launcher. By utilizing a foam-like adhesive layer, the isolation material can serve to both attach the beam generating components to the launcher, and to isolate the beam generating components from vibratory forces generated by the launcher.

Figure 9:
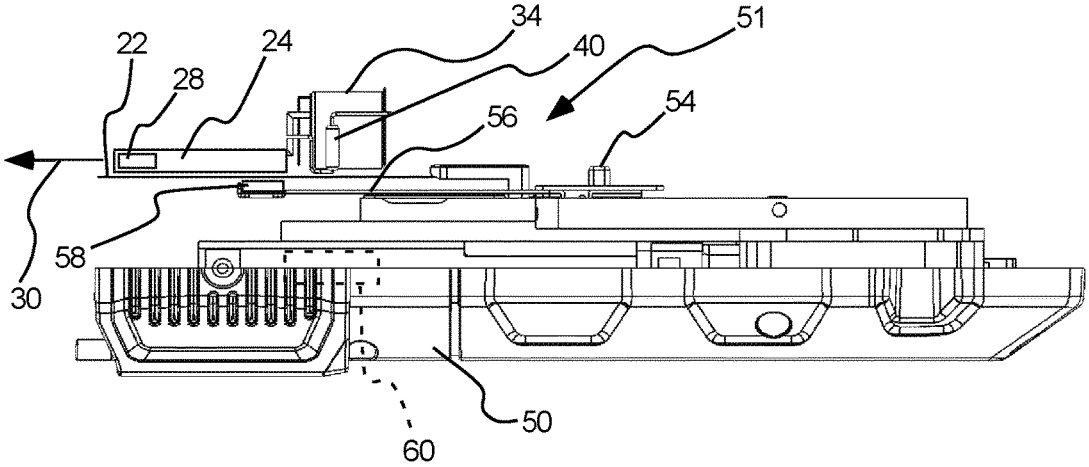
FIG. 9 is a side, partially sectioned view of a launcher carrying a beam generating system in accordance with the present technology.

FIG. 9 illustrates a further embodiment of the invention in which a switching assembly, shown generally at 51, is provided to enable an operator to activate the beam generating system. The system can include a switch 54 that can, in some embodiments, be operable to disengage the safety setting of the launcher. An extension 56 can be coupled to the switch and can extend forwardly from the switch. A magnetic material 58 can be carried by the extension. In the embodiment shown, the magnetic material comprises a small disk magnet. Movement of the switch 54 forwardly and rearwardly can result in a corresponding forward and rearward movement of the magnetic material.

As referenced briefly in connection with FIG. 5, in one embodiment the beam generating system can include a reed switch 40. The reed switch can be activated when subject to a magnetic field. In the position shown in FIG. 9, the magnetic disk 58 is displaced from the reed switch 40. In this position, the safety mechanism of the launcher is also engaged. As the switch 54 is moved rearward relative to the launcher body or casing 50 (rightward in FIGS. 9 and 10), the magnetic disk is positioned beneath the reed switch 40. This results in activation of the beam generating system and also results in placing the launcher in condition to fire (e.g., the safety has been disabled).

In this manner, the beam generation system can be activated without a physical connection required between the launcher and the beam generating system. In one aspect of the invention, the reed switch and the magnetic disk are separated by a space of some dimension. In the embodiment shown in FIGS. 9 and 10, this space is at least partially filled by a wall thickness of the casing 50. This casing 50 can be formed from a polymer, or similar material that does not interfere with the magnetic field generated by the disk. In this manner, the launcher 12 (which includes the switch 54, the extension 56 and the magnetic disk 58) and the beam generating system are completely separable one from another. As shown in FIG. 10, the casing 21 that encapsulates the beam generating system can be independently provided and attached to the launcher casing. This can allow the beam generating assembly to function independently of the launcher, without requiring a rigid, physical contact between the switching mechanisms of the two.

In addition to the structure described above, the present technology also provides a method of generating a targeting beam, comprising: providing a light source (which can be a laser light source) operable to generate a visible light beam; and oscillating the light source with a motor (e.g., a micromotor) to create oscillatory motion of the light beam generated by the light source to cause the light beam to generate a targeting beam on one or more surfaces spaced from the light source. Oscillating the light source can include oscillating the light source at a frequency of at least about 24 Hz or greater.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. A system for generating a targeting beam, comprising:
- a launcher;
- a frame coupled to or formed as a portion of the launcher, the frame carrying at least one moveable arm, at least a portion of the moveable arm being moveable relative to the frame;
- a light source carried by the moveable arm, the light source being operable to generate a light beam;
- a motor carried by the moveable arm, the motor operable to create oscillatory motion of the moveable arm to cause the light beam generated by the light source to oscillate through a range of motion to create a targeting beam; and
- a shock isolation material coupled to the launcher, the frame being coupled to the shock isolation material such that the shock isolation material shields the frame from vibration caused by activation of the launcher.

2. The system of claim 1, wherein an underside surface of the frame is substantially completely covered by the shock isolation material.

3. The system of claim 1, wherein the shock isolation material includes a flexible adhesive sheet.

4. The system of claim 1, further comprising a switching assembly operable to energize the light source and/or the motor, the switching assembly including a magnetic material, the magnetic material being moveable relative to the frame.

5. The system of claim 4, wherein the switching assembly further includes a reed switch carried by the frame, the reed switch being disposed distally from the magnetic material and being activatable by the magnetic material when the reed switch and the magnetic material are separated from one another by a space.

* * * * *